US005418552A

United States Patent [19]

Maruyama

[11] Patent Number: 5,418,552

[45] Date of Patent: May 23, 1995

[54] THERMAL TRANSFER PRINTER USING RIBBON CASSETTE

[75] Inventor: Takahito Maruyama, Morioka, Japan

[73] Assignee: Alps Electric Co., Ltd., Tokyo, Japan

[21] Appl. No.: 29,264

[22] Filed: Mar. 10, 1993

[30] Foreign Application Priority Data

Mar. 19, 1992 [JP] Japan ..... 4-063974

[51] Int. Cl.[6] ..... B41J 32/00; B41J 33/04; B41J 2/325

[52] U.S. Cl. ..... 347/214; 400/207; 400/248; 400/208; 400/208.1

[58] Field of Search ..... 400/207, 208, 208.1, 400/120, 248, 185, 187, 186; 346/76 PH

[56] References Cited

U.S. PATENT DOCUMENTS

| | | | |
|---|---|---|---|
| 4,750,007 | 6/1988 | Suzuki | 346/76 PH |
| 4,784,502 | 11/1988 | Kobayashi | 400/248 |
| 4,887,096 | 12/1989 | Asakura et al. | 346/76 PH |
| 5,030,967 | 7/1991 | Inoue et al. | 346/76 PH |
| 5,064,301 | 11/1991 | Nakamura et al. | 400/120 |
| 5,199,805 | 4/1993 | Kawazde et al. | 400/248 |

*Primary Examiner*—Huan H. Tran
*Attorney, Agent, or Firm*—Guy W. Shoup; Patrick T. Bever

[57] ABSTRACT

A thermal transfer printer including: a carriage 5 provided for causing reciprocatory motions along a platen 2; a thermal head 6 disposed on this carriage 5; a ribbon cassette 21 accommodating an ink ribbon 14 therein and detachably installed on the upper surface of the carriage 5; a head operating mechanism 30 for supporting the thermal head 6 on the carriage 5 and bringing the thermal head 6 into contact with or releasing it from the platen 2; a driving motor for driving this head operating mechanism 30; a peeling roller 20 brought into contact with or released from the platen 2 in order to change a distance between a printing portion by the thermal head 6 and a peeling portion where the ink ribbon 14 is peeled off after finishing the printing operation; and a peeling lever 19 mounting the peeling roller 2 at the distal end thereof and including an engaging pin 50 which is pressed to engage with the head operating mechanism 30 in accordance with a kind of the ribbon cassette 21.

13 Claims, 8 Drawing Sheets

THERMAL TRANSFER PRINTER USING RIBBON CASSETTE

BACKGROUND OF THE INVENTION

1. Field of the Invention

The present invention relates to a thermal transfer printer using a ribbon cassette, and more particularly to a thermal transfer printer capable of performing the hot peeling and the cool peeling of the ink ribbon by selectively operating the peeling roller.

2. Description of the Prior Art

FIG. 12 shows a conventional thermal transfer printer, which includes a frame 1. A flat platen 2 is provided at the center of this frame 1, so that its printing surface is disposed vertically. A carriage shaft 3 is disposed in front of and below the platen 2, so as to be disposed in parallel with each other.

A guide 4, formed in a flange-like shape, is provided at the front edge of the frame 1. A carriage 5 is mounted on the carriage shaft 3 and the guide 4 so that the carriage 5 can cause reciprocatory motions along these carriage shaft 3 and guide 4. Provided on the edge of the carriage 5 is a thermal head 6, which is disposed to confront with the platen 2 and driven by a driving mechanism (not shown) so as to be brought into contact with the platen 2 or shifted away from the platen 2.

The carriage 5 has an upper surface, on which a ribbon cassette (not shown) is detachably installed. The ribbon cassette accommodates an ink ribbon, and guides this ink ribbon to enter between the thermal head 6 and the platen 2. Also provided on the upper surface of the carriage 5 are a take-in bobbin 7 for taking in the ink ribbon of the ribbon cassette and a feed bobbin 8 for feeding the ink ribbon.

Behind the platen 2, there is provided a paper insertion opening 9 for feeding a sheet of paper forward beyond the platen 2. A paper feed roller 10 is disposed adjacent to the paper insertion opening 9 to feed the paper at a predetermined speed. This paper feed roller 10 is paired with a press roller 11, which is disposed rotatably just beneath and pressed against the paper feed roller 10. A paper feed motor 13 is provided on one side surface of the frame 1. This paper feed motor 13 drives the paper feed roller 10 through a transmission gear train 12 to cause rotation. Thus, the paper inserted into the paper insertion opening 9 is sandwiched by these paper feed roller 10 and the press roller 11 and conveyed by the driving force of the paper feed motor 13.

In the above-described conventional printer, the paper is inserted from the paper insertion opening 9 and sandwiched between the paper feed roller 10 and the press roller 11. And, the paper is conveyed at a predetermined speed in a direction normal to the shifting direction of the carriage 5 by rotating the paper feed roller 10 by the paper feed motor 13.

On the other hand, the carriage 5 is shifted under the condition the thermal head 6 is pressed against the paper at a predetermined pressure. Meanwhile, the take-in bobbin 7 is rotated to take in the ink ribbon of the ribbon cassette. The thermal head 6 is driven on the basis of desired printing signals. Thus, the printing operation can be carried out preferably.

By the way, various kinds of papers are used as printing papers. For example, generally known is a normal paper. An OHP sheet, made of plastic sheet having light permeability and used for the overhead projector (OHP), is also known as a printing paper. This OHP sheet, however, requires another ink ribbon different from for the normal paper.

The ink ribbon 14 used for the normal papers is, for example, constituted as shown in FIG. 13(A). A base member 15 is made of resin film such as polyethylene terephthalate. An ink layer 16, made by mixing resin and color such as carbon, is formed on the surface of this base member 15. Furthermore, an overcoat layer 17, made of high-viscous material such as polyamide, is formed on the surface of this ink layer 16.

Another example of the ink ribbon 14 is shown in FIG. 13(*b*). This ink ribbon 14 further includes a peeling layer 18 made of wax and having thermal solubility, which is interposed between the base member 15 and the ink layer 16.

In the case where this kind of ink ribbon 14 is used for printing normal papers, the thermal head 6 is driven to perform the hot peeling operation. That is, the ink ribbon 14 is peeled off from the normal paper during the time when the melted ink layer 16 is still maintained at hot temperature in the partly melted condition. For this reason, it is necessary to shorten the distance between the printing portion of the thermal head 6 and the peeling portion of the ink ribbon 14.

On the contrary, one example of the ink ribbon 14 used for the OHP sheet is shown in FIG. 13(*c*). The ink ribbon 14 includes the base member 15 made of resin film. The ink layer 16, the mixture of carbon and wax, is laminated on the surface of this base member 15.

In the case where this kind of ink ribbon 14 is used for printing OHP sheets, the thermal head 6 is driven to perform the cool peeling operation. That is, the ink ribbon 14 is peeled off from the OHP sheet after the melted ink layer 16 cools down and solidifies, so that the transferred ink surface becomes smooth. For this reason, it is necessary to enlarge the distance between the printing portion of the thermal head 6 and the peeling portion of the ink ribbon 14.

In this manner, there is a difference between the printing operation for the normal papers and the printing operation for the OHP sheets in the position where the ink ribbon 14 is peeled off from these recording mediums. Accordingly, the conventional thermal transfer printer, compatible with both the normal papers and the OHP sheets, usually equips a peeling roller 19 that can change the peeling position of the ink ribbon 14 as shown in FIG. 14.

Namely, a peeling lever 20 is disposed on the upper surface of the carriage 5 at the downstream of the thermal head 6 in the travelling direction of the ink ribbon 14. In the drawing, this peeling lever 20 is driven to swing between an outermost position indicated by the solid line and an innermost position indicated by the dotted line by means of an appropriate driving mechanism (not shown). This peeling lever has a peeling roller 19 provided to protrude upward at the distal end thereof. This peeling roller 19 is brought into contact with or away from the ink ribbon 14 at the downstream of the thermal head 6 in the travelling direction of the ink ribbon 14.

In the case where the peeling lever 20 is positioned at the solid-line position in the drawing, the peeling roller 19 approaches the platen 2 and is pressed against the ink ribbon 14. By delaying the peeling operation of this ink ribbon 14 from the recording medium, the ink layer in the ink ribbon 14 cools and solidifies before the ink ribbon 14 is peeled off from the recording medium. Thus, the cool peeling operation is accomplished.

On the other hand, in the case where the peeling lever 20 is positioned at the dotted-line position in the drawing, the peeling roller 19 parts from the ink ribbon 14 and positions in the ribbon cassette 21. In this case, the ink ribbon 14 is immediately peeled off from the recording medium as soon as the thermal head 6 passes. Thus, the hot peeling operation is carried out in such a manner that the ink ribbon 14 is peeled off from the recording medium during the time when the ink layer 16 of the ink ribbon 14 is in the melted condition.

However, this conventional thermal transfer printer described above uses the driving device such as a solenoid and the like to cause the swing motion of the peeling lever 20 in order to bring the peeling roller 19 into contact with the platen 2 or release it. Therefore, it is necessary to exclusively provide this driving device for operating the peeling roller 19, in addition to the driving device for bringing the thermal head 8 into contact with the platen 2 and the driving device for taking-in the ink ribbon 14.

This makes the control of the driving devices complicated. Furthermore, an overall size of the system increases as numerous devices must be installed on the carriage 5. The manufacturing cost will correspondingly increase.

SUMMARY OF THE INVENTION

Accordingly, the present invention has a purpose, in view of above-described problems or disadvantages, to provide a thermal transfer printer which is capable of selectively operating the peeling roller without providing additional driving device, reducing the installation space, and minimizing the overall size of the apparatus. And also, the present invention has a purpose to provide a ribbon cassette used for this novel thermal transfer printer.

In order to accomplish above purposes, one aspect of the present invention provides a thermal transfer printer comprising: a carriage provided for causing reciprocatory motions along a platen; a thermal head disposed on this carriage; a ribbon cassette accommodating an ink ribbon therein and detachably installed on the upper surface of the carriage; a head operating mechanism for supporting the thermal head on the carriage and bringing the thermal head into contact with or releasing it from the platen; a means for driving this head operating mechanism; a peeling member brought into contact with or released from the platen in order to change a distance between a printing portion by the thermal head and a peeling portion where the ink ribbon is peeled off after finishing printing operation; and a peeling lever mounting the peeling member at the distal end thereof and including an engaging member which is pressed to engage with the head operating mechanism in accordance with a kind of the ribbon cassette.

Furthermore, in accordance with another aspect of the present invention, the cassette case includes a press member for pressing the engaging member of the peeling lever in a condition where the cassette is installed on the carriage.

In accordance with the present invention, the peeling lever mounting the peeling member at the distal end thereof is equipped with the engaging member which is pressed to engage with the head operating mechanism in accordance with the kind of the ribbon cassette. Therefore, the engaging member is pressed downward until it engages with the head operating mechanism under the condition where the ribbon cassette is installed on the carriage. In this case, the peeling lever is rotated together with the head operating mechanism. With the thermal head being pressed against the platen, the peeling member is pressed against the platen. Thus, the peeling distance of the ink ribbon can be enlarged.

Preferably, the ribbon cassette is provided with the press member. For example, if only the ribbon cassette accommodating the ink ribbon preferable in use for the cool peeling operation is provided with the pressing member, the peeling member is pressed against the platen only when this ribbon cassette accommodating the ink ribbon preferable in use for the cool peeling operation is installed on the carriage.

The above and other objects, features and advantages of the present invention will become more apparent from the following detailed description which is to be read in conjunction with the accompanying drawings.

DETAILED DESCRIPTION OF THE PREFERRED EMBODIMENTS

Figure 1:
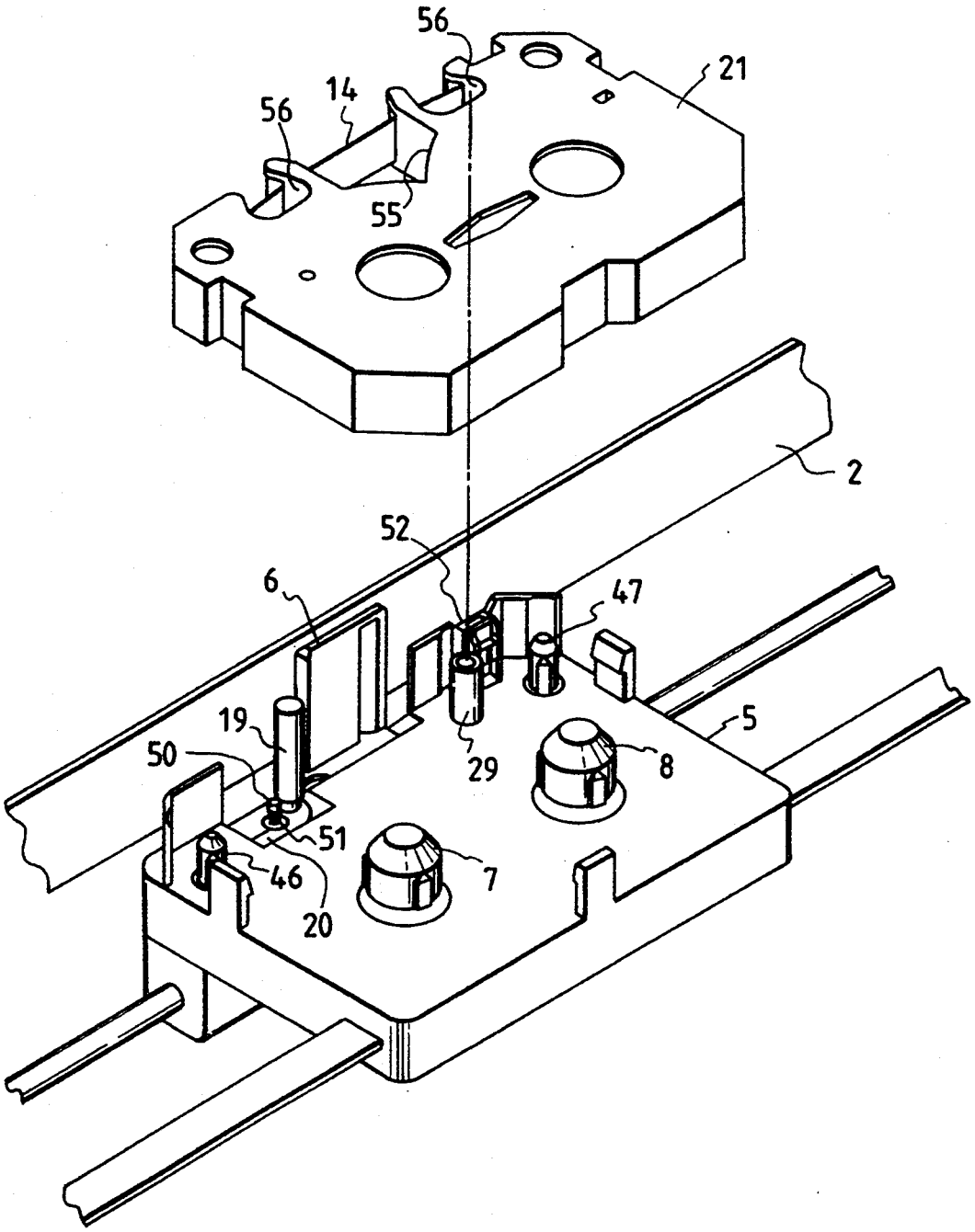
FIG. 1 is a perspective view showing a thermal transfer printer in accordance with a first embodiment of the present invention.

Hereinafter, with reference to FIGS. 1 through 9, preferred embodiments of the present invention are explained in detail.

FIGS. 1 through 7 show a thermal transfer printer in accordance with the first embodiment of the present invention. A carriage 5 causes reciprocatory motions along a platen 2. This carriage 5 mounts a motor 22, which brings a thermal head 6 into contact with or releases it from the platen 2 or controls the take-in operation of the ink ribbon. This motor 22 has an output pinion gear 23, with which a transmission gear 24 is meshed. This transmission gear 24 is meshed with a gear portion 28 formed on outer circumferential surface of a cam 25. This cam 25 has a head operate cam groove 27 and a ribbon take-in cam groove 28 formed thereon. This ribbon take-in cam groove 28 is formed wider and narrower than the head operate cam groove 27.

A support shaft 29 is provided on the carriage 5 adjacent to the platen 2. This support shaft 29 protrudes upward from the upper surface of the carriage 5. A head lever 30 of substantially T-shaped is mounted on this support shaft 29 so as to be swingable about this support shaft 29. A head installation base 31 is fixed by means of a screw on one edge of this head lever 30 close to the platen 2, so that this head installation base 31 confronts with the platen 2. A thermal head 6 is secured on the surface of this installation base 31 confronting with the platen 2. A stopper 32 faces with the back surface of the installation base 31, with a predetermined clearance therebetween.

A head press lever 33 of substantially L-shaped is also mounted on the support shaft 29, so as to swing about this support shaft 29. This head press lever 33 has a pin 34 on one end thereof, which is engaged with the head operate cam groove 27 of the cam 25. The other end of the head press lever 33 interposes between the back surface of the head installation base 31 and the stopper 32 of the head lever 30. A spring retainer 35 is provided on the other end of the head press lever 33. A strong press spring 36 interposes between the spring retainer 35 and the head installation base 31. By virtue of the spring force of this strong press spring 36, the head press lever 33 abuts the stopper 32 of the head lever 30. In this condition, the head press lever 33 and the head lever 30 rotate together in response to the rotation of the cam 25 during the head-up and head-down operations.

A drive gear 38 is disposed on the carriage 5, so as to be rotatable about a support shaft 39. This drive gear 38 meshes with a rack 37 provided in the printer. A weak press spring 40 interposes between the support shaft 39 and the head lever 30. This weak press spring 40 has a spring force smaller than that of the strong press spring 36, and is disposed in such a manner that the head lever 30 always presses the thermal head 6 against the platen 2.

A swing plate 41 is mounted on the support shaft 39, so as to be swingable about the support shaft 39. This swing plate 41 has a pin 42 formed on one end thereof, which is engaged with the ribbon take-in cam groove 28. Here, the pin 42 of the swing plate 41 is thicker than the width of the head operate cam groove 27, so that the pin 42 is not fallen into the head operate cam groove 27. The swing plate 41 also has a support shaft 43 on the other end thereof, on which a transmission gear 44 is rotatably mounted. This transmission gear 44 meshes with the drive gear 38.

A take-in bobbin 7 for taking in an ink ribbon and a feed bobbin 8 for feeding the ink ribbon are both disposed on the carriage 5, as shown in FIG. 1. The take-in bobbin 7 has a take-in gear 45 provided coaxially at the lower end thereof, which meshes with the transmission gear 44 through a frictional mechanism (not shown).

This embodiment includes a secondary take-in bobbin 46 and a secondary feed bobbin 47, respectively disposed on the carriage 5. The secondary take-in bobbin 46 has a secondary take-in gear 49 provided coaxially at the lower end thereof, which meshes with the take-in gear 45 of the take-in bobbin 7 via the transmission gear 48 through a frictional mechanism (not shown).

The take-in bobbin 7 and the secondary take-in bobbin 46 rotate in response to the mesh-engagement between the transmission gear 44 and the take-in gear 45 caused by the swing plate 41. The feed bobbin 8 and the secondary feed bobbin 47 are free to rotate.

A peeling lever 20 is mounted rotatably on the rotational shaft of the secondary take-in bobbin 46. A spring 58 draws this peeling lever 20 to release the peeling lever 20 from the platen 2. This peeling lever 20 has a peeling roller 19 protruding upward from the distal end thereof. Provided adjacent to the peeling roller 19 of the peeling lever 20 is an engaging pin 50, which is shiftable in an up-and-down direction. A spring 51, provided on the upper surface of the peeling lever 20 around the periphery of the engaging pin 50, urges this engaging pin 50 upward. By virtue of this spring 51, the lower end of this engaging pin 50 is held not to protrude below the peeling lever 20. If the engaging pin 50 is pressed downward against the spring 51 until its lower end protrudes below the peeling lever 20, the engaging pin 50 engages with the distal end of the head lever 30.

Figure 6:
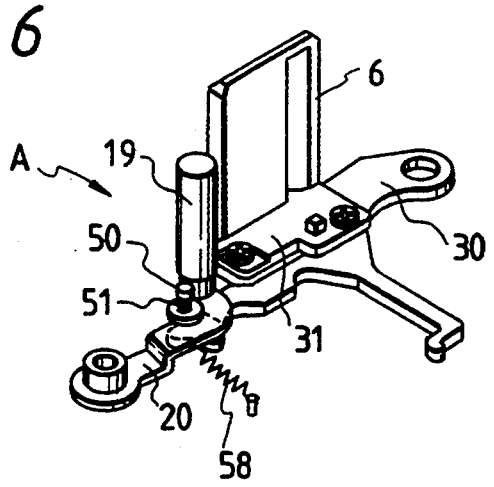
FIG. 6 is a perspective view partly showing a peeling lever and a head lever of the thermal transfer printer in accordance with the present invention.
Figure 7A:
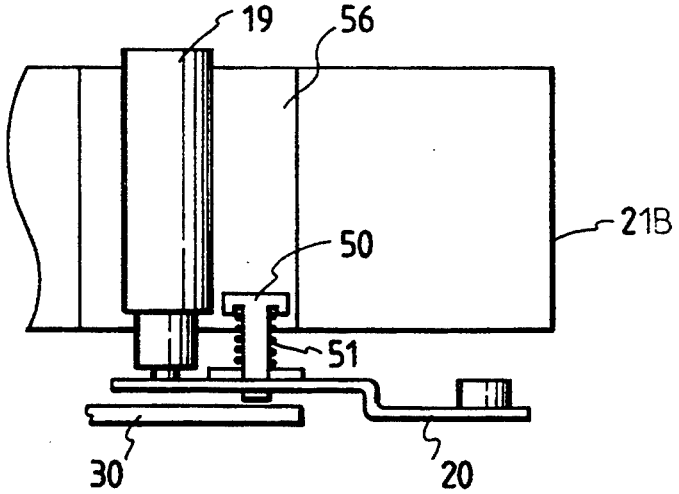
FIGS. 7(*a*) and 7(*b*) are views illustrating engaging and disengaging conditions of the peeling lever and the head lever of the thermal transfer printer in accordance with the present invention.
Figure 7B:
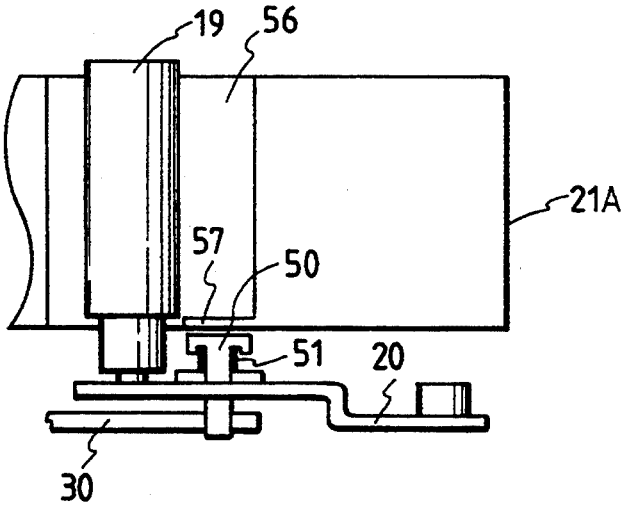
Figure 8:
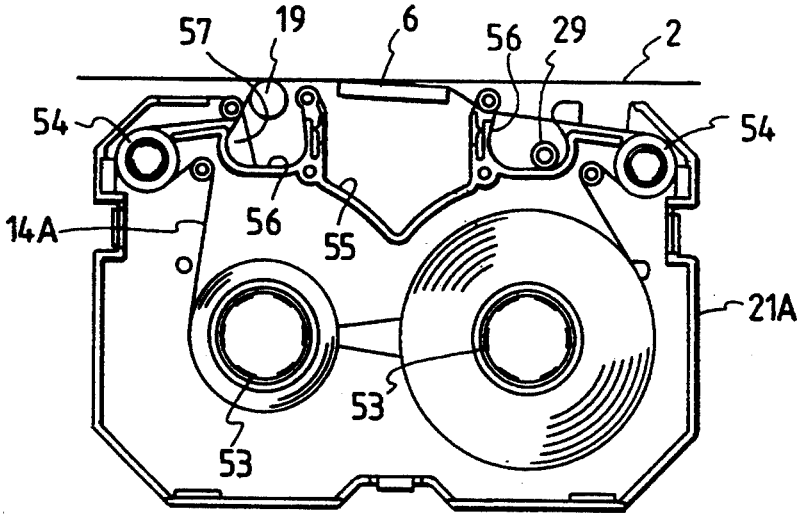
FIG. 8 is a cross-sectional plane view showing a ribbon cassette used for the cool peeling operation of the thermal transfer printer in accordance with the present invention.

FIG. 6 shows the peeling lever 20 and the head lever 30 more precisely. FIGS. 7(*a*) and 7(*b*) are both side views, seen from a direction of an arrow A in FIG. 6. FIG. 7(*a*) shows a condition the engaging pin 50 does not protrude downward so that the peeling lever 20 is disengaged from the head lever 30. FIG. 7(*b*) shows a condition the engaging pin 50 protrudes downward so that the peeling lever 20 is engaged with the head lever 30.

Furthermore, the carriage 5 has a photo sensor 52 provided on the upper surface thereof, which detects an end of the ink ribbon or a color marker of the color ink ribbon.

A ribbon cassette 21 accommodating an ink ribbon 14 is detachably installed on the upper surface of the carriage 5. This ribbon cassette 21 is equipped with a pair of hubs 53, 53, around which the ink ribbon 14 is wound and with which the take-in bobbin 7 and the feed bobbin 8 engage. The ribbon cassette 21 is further equipped with a pair of guide rollers 54, 54, which engages with the secondary take-in bobbin 46 and the secondary feed bobbin 47 to guide the ink ribbon 14. Provided at the center of the ribbon cassette 21 adjacent to the platen 2 is a recessed portion 55, inside which the thermal head 6 is inserted. A pair of cutout portions 56, 56 is formed symmetrically at both sides of the recessed portion 55 of the ribbon cassette 21. The support shaft 29 is inserted in this cutout portion 56.

There are prepared two kinds of ribbon cassettes 21, 21. One is a ribbon cassette 21A shown in FIG. 8, which accommodates the ink ribbon cassette 14A used for the cool peeling operation. The other is a ribbon cassette 21B shown in FIG. 9, which accommodates the ink ribbon cassette 14B used for the hot peeling operation.

In the cutout portion 56 of the ribbon cassette 21A accommodating the ink ribbon 14A, there is provided a press board 57 that presses the engaging pin 50 of the carriage 5 downward. When this ribbon cassette 21A is installed on the carriage 5, the press board 57 presses the engaging pin 50 downward until the lower edge of this engaging pin 50 engages with the head lever 30 as shown in FIG. 7(*b*).

On the other hand, there is provided pin reception area (no press board) in the cutout portion 56 of the ribbon cassette 21B accommodating the ink ribbon 14B. When this ribbon cassette 21B is installed on the carriage 5, the engaging pin 50 is not pressed down and therefore the lower edge of this engaging pin 50 is engaged from the head lever 30 as shown in FIG. 7(*a*).

The reason why these two cutouts 56, 56 are symmetrically provided at both sides of the recessed portion 55 into which the thermal head 6 is inserted is that the ribbon cassette shown in FIG. 1 is a multi-time ink ribbon that is usable even when reversed. On the other hand, only one cutout 58 is required in the case where the so-called one-time ink ribbon is used.

Figure 2:
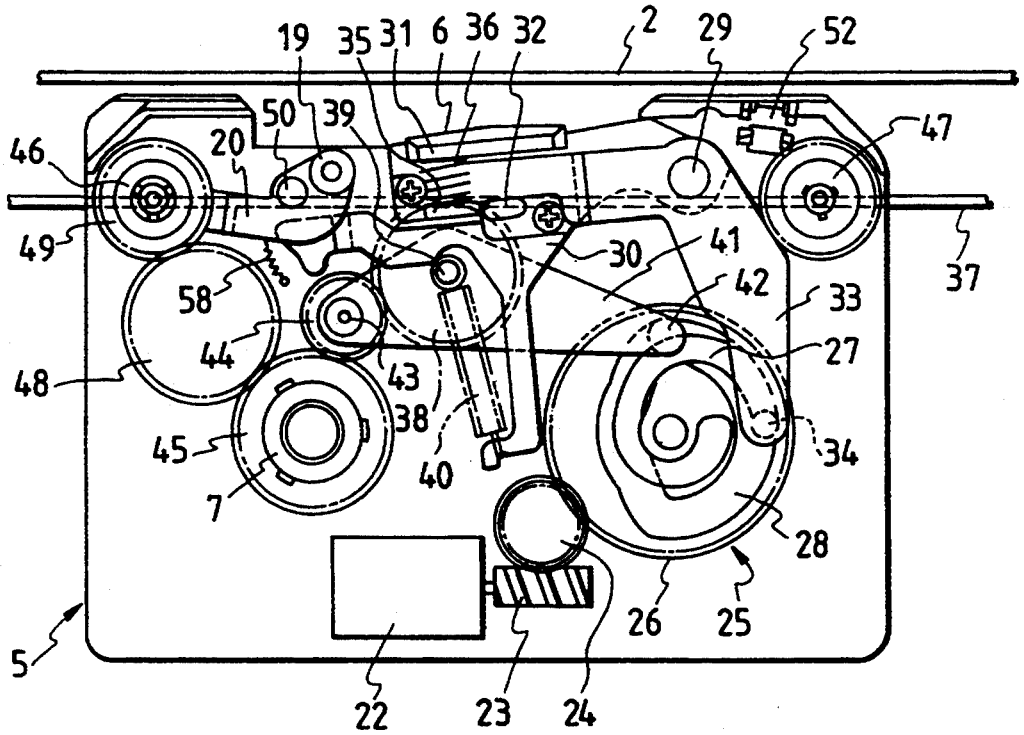
FIG. 2 is a view showing a carriage configuration of the thermal transfer printer in accordance with the first embodiment of the present invention.

Next, an operation of this embodiment will be explained below. First of all, as shown in FIG. 2, the cam 25 is positioned at the left end of its rotation. The pin 34 of the head press lever 33 is positioned at an outermost end of the head operate cam groove 27. The head press lever 33 is positioned at the left end of its swing motion. The head press lever 33 abuts the stopper 32 of the head lever 30 by means of the strong press spring 38. The head installation base 31 is moved together with the head press lever 33. With this motion of the head press lever 33, the thermal head 8 is maintained in the head-up condition in which the thermal head 8 is spaced from the platen 2.

On the other hand, the swing plate 41 is swung leftward by the ribbon take-in cam groove 28. The transmission gear 44 supported on the swing plate 41 meshes with the take-in gear 45. The carriage 5 shifts along the platen 2. Then, the drive gear 38, which meshes with the rack 37, is driven to rotate. Through the transmission gears 44, 48, the take-in gear 45 and the secondary take-in gear 49 are both rotated. And, the take-in bobbin 7 and the secondary take-in bobbin 48 are also rotated. The ink ribbon 14 rotates in accordance with the rotations of the take-in bobbin 7 and the secondary take-in bobbin 46.

No printing operation is carried out in this cam 25 position. The color sensing by the photo sensor 52 is carried out in the case where the color ink ribbon 14 is used, or the sagging removal of the ink ribbon 14 is carried out.

Figure 3:
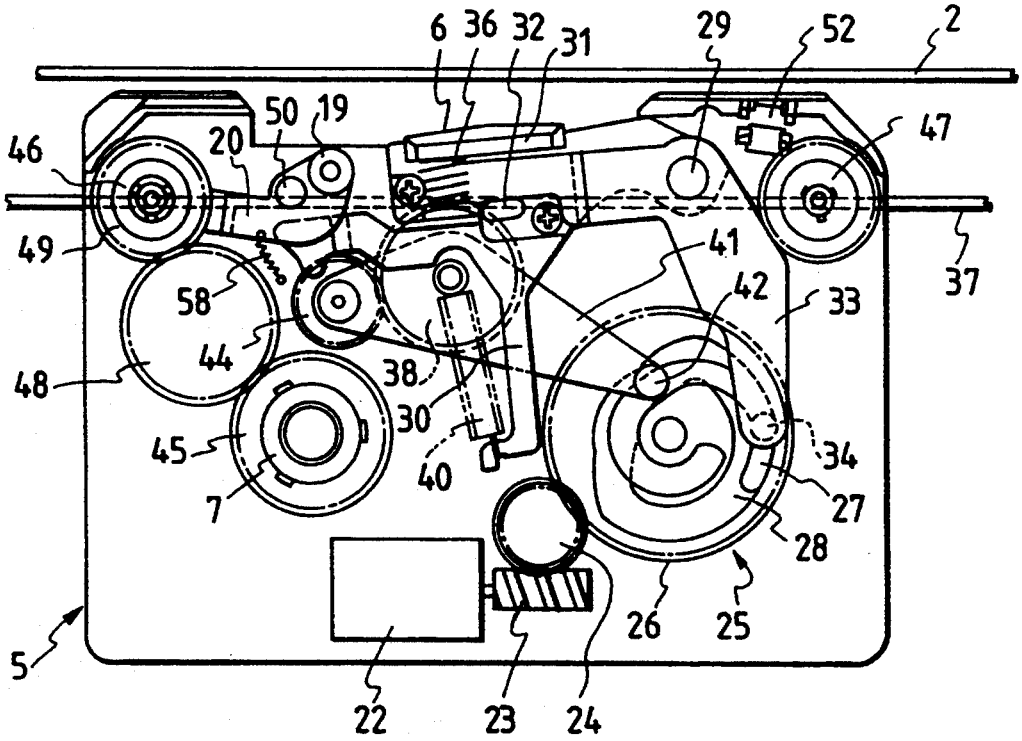
FIG. 3 is a view showing a condition the carriage of the thermal transfer printer in accordance with the first embodiment of the present invention is retracted.

Next, as shown in FIG. 3, the cam 25 rotates rightward from the condition shown in FIG. 2 by driving the motor 22. The head press lever 33 does not cause a swing motion. While maintaining the head-up condition in which the thermal head 6 is spaced from the platen 2, the swing plate 41 swings rightward by the ribbon take-in cam groove 28 and the transmission gear 44 of the swing plate 41 disengages from the take-in gear 45. In this condition, the rotation of the drive gear 38 is not transmitted to the take-in bobbin 7 and the secondary take-in bobbin 46 even if the carriage 5 causes a shift motion. Since no take-in operation of the ink ribbon 14 is performed, this is used for the return motion of the carriage 5 or the ribbon save motion.

Figure 4:
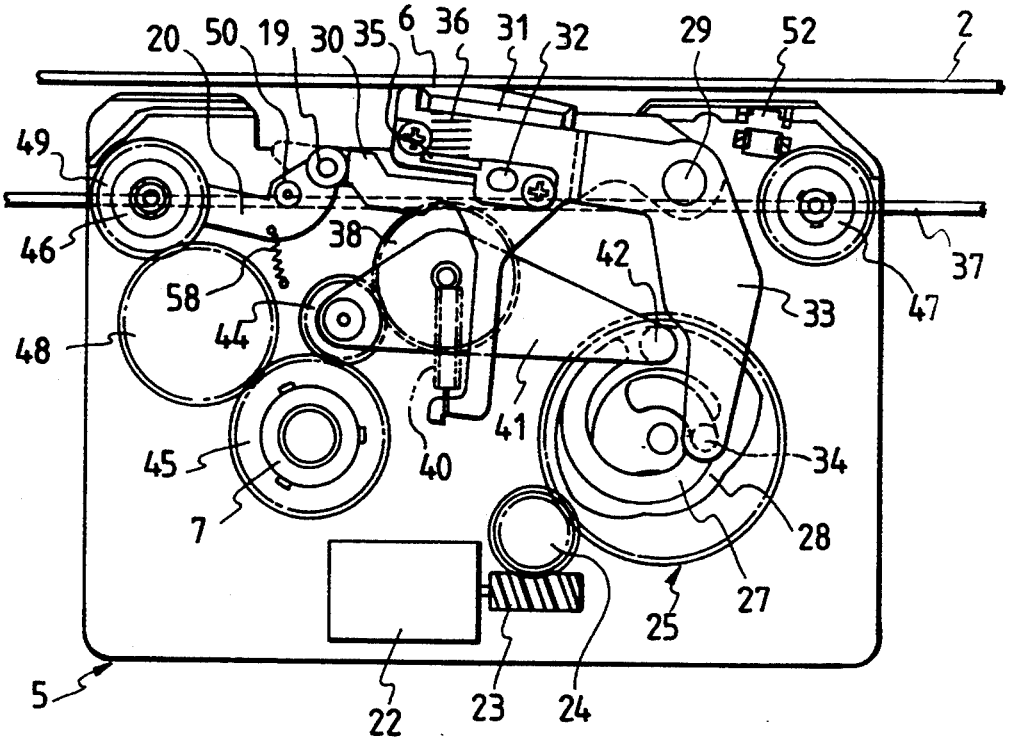
FIG. 4 is a view showing a condition the thermal transfer printer in accordance with the present invention performs the printing operation for normal papers.
Figure 9:
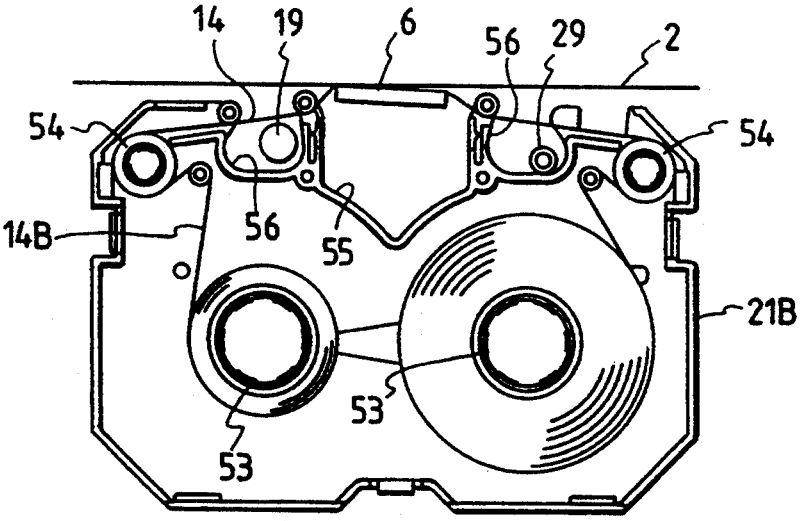
FIG. 9 is a cross-sectional plane view showing a ribbon cassette used for the hot peeling operation of the thermal transfer printer in accordance with the present invention.

Next explained is the case where the carriage 5 installs the ribbon cassette 21B of FIG. 9, which accommodates the ink ribbon 14B used for the hot peeling operation, in order to perform the printing operation of normal papers. As shown in FIG. 4, the cam 25 rotates rightward from the condition shown in FIG. 3 by further driving the motor 22. The head press lever 33 causes a swing motion rightward. In response to this swing motion, the head lever 30 swings together with the head lever 33 through the strong press spring 36. In this moment, the pin 34 of the head press lever 33 positions at substantially the center of the rotation in the head operate cam groove 27. Therefore, the head press lever 33 is swung about the support shaft 29 toward the right end. With this swing motion, the head installation base 31 is pressed through the strong press spring 36 by the spring retainer 35 of the head press lever 33. As the spring force of the weak press spring 40 is applied to the head lever 30 in this condition, the head installation base 31 is applied a sum of the pressing force of the strong press spring 36 and the pressing force of the weak press spring 40. Thus, the thermal head 6 is pressed against the platen 2 by the strong press force.

As the ribbon cassette 21B used for the hot peeling operation has no press board 57, it does not press the engaging pin 50 of the carriage 5 as shown in FIG. 7(*a*). Therefore, the engaging pin 50 does not engage with the head lever 30. As a result, even if the head lever 30 causes a rotation, the peeling lever 20 does not cause a rotation and the peeling roller 19 remains the same position.

The support shaft, which serves as the rotational center of the head lever 30 pressing the thermal head 6 against the platen 2 and the head press lever 33, is made longer in this embodiment so as to protrude upward from the upper surface of the carriage 5. The supporting point of the head lever 30 or the head press lever 33 does not cause no backlash. The head lever 30 and the like can be accurately supported and, thus, the thermal head 8 can be stably pressed against the platen 2.

On the other hand, the swing plate 41 rotates leftward from the condition shown in FIG. 3. The transmission gear 44 of the swing plate 41 again meshes with the take-in gear 45, and the ribbon take-in operation is carried out in accordance with the shift motion of the carriage 5.

By shifting the carriage 5 in this condition, the drive gear 38 rotates through the rack 37. By rotating the take-in gear 45 and the secondary take-in gear 49 though the transmission gears 44, 48, the take-in bobbin 7 and the secondary take-in bobbin 46 are rotated and the ink ribbon 14 of the ribbon cassette 21 is taken in. Then, the printing operation in carried out on a desired paper by driving the thermal head 6 in accordance with desired printing signals. The printing operation can be nicely performed in this case, as the thermal head 6 is pressed by the strong press force.

Figure 5:
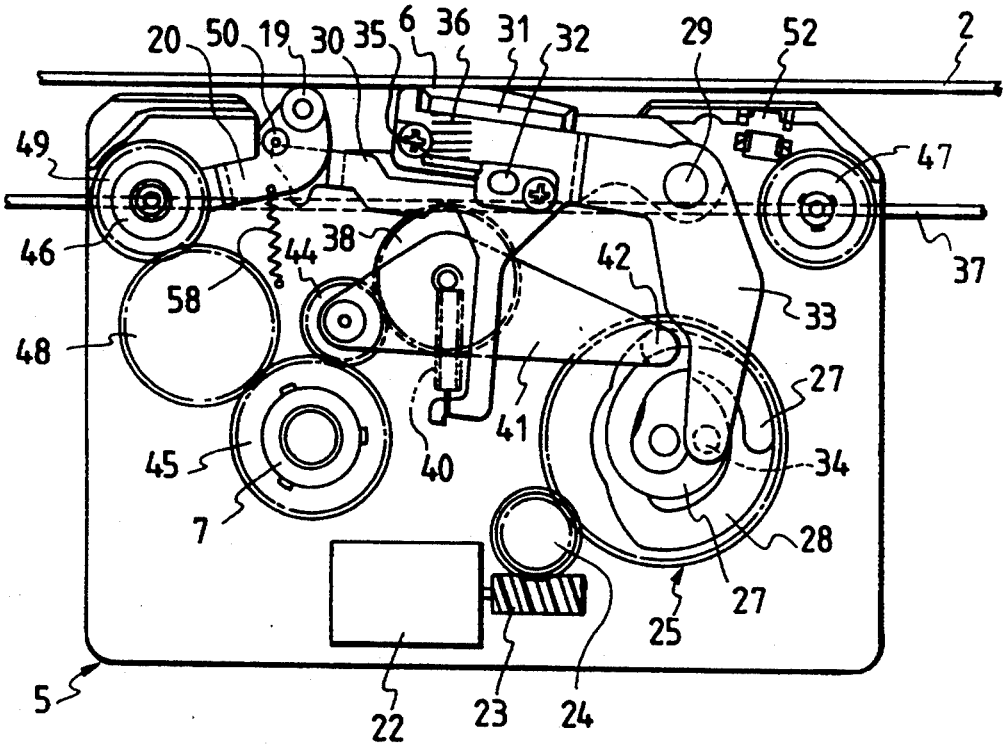
FIG. 5 is a view showing a condition the thermal transfer printer in accordance with the present invention performs the printing operation for OHP sheets.

Furthermore, in the case where the carriage 5 installs the ribbon cassette 21A accommodating the ink ribbon 14A used for the cool peeling operation in order to perform the printing operation on the OHP sheet, the cam 25 rotates leftward from the condition shown in FIG. 3 through the condition shown in FIG. 4 to the condition shown in FIG. 5 by driving the motor 22.

In the same way as in the previous case of FIG. 4, the head press lever 33 swings rightward together with the head lever 30. The pin 34 of the head press lever 33 positions at the innermost end of the head operate cam groove 27 in this condition. As the width of the head operate cam groove 27 is enlarged at this innermost end, there is formed a clearance between the pin 34 of the head press lever 33 and the head operate cam groove 27. With this clearance, the head press lever 33 rotates to abut the stopper 32 by the spring force of the strong press spring 36. Thus, the thermal head 6 is pressed against the platen 2 only by the weak press spring 40. Therefore, the printing operation is carried out by the weak pressing force compared with the normal printing operation.

Furthermore, the ribbon cassette 21A accommodating the ink ribbon 14A for the cool peeling operation equips the press board 57. This press board 57 presses the engaging pin 50 downward as shown in FIG. 7(*b*), so that the engaging pin 50 engages with the head lever 30. If the head lever 30 causes a swing motion, the peeling lever 20 rotates through the engaging pin 50. The peeling roller 19 is pressed against the platen 2, so as to enlarge the peeling distance of the ink ribbon 14.

On the other hand, even if the cam 25 causes a rotation, the transmission gear 44 of the swing plate 41 is maintained in the condition in which the transmission gear 44 meshes with the take-in gear 45. The take-in operation of the ink ribbon 14 is carried out in accordance with the shift motion of the carriage 5 in the same fashion as in the case of the normal printing operation.

By selecting the position of the cam 25 in accordance with the required circumstances in this manner, the thermal transfer printer can perform various operations required.

Though the above description explains the operation successively selecting the position of the cam 25 from the condition shown in FIG. 2 to the condition shown in FIG. 5, the cam 25 is driven in the opposite direction in the case where the position of the cam 25 is changed from the condition shown in FIG. 5 to the condition shown in FIG. 2.

Accordingly, in accordance with this embodiment, the engaging pin 50 of the peeling lever 20 is pressed by the press board 57 formed in the ribbon cassette 21A so that the engaging pin 50 engages with the head lever 30. The peeling lever 20 is moved by rotating the head lever 30, so that the peeling roller 19 can be brought into contact with or released from the platen 2. Thus, no additional driving device for driving the peeling lever 20 is required. The control of the driving device becomes easy. Furthermore, an overall size of the apparatus can be reduced as the carriage 5 needs not to provide a wide installation space. Moreover, the cost of parts reduces and the apparatus can be manufactured at low cost.

Still further, as the press board 57 pressing the engaging pin 50 is provided only in the ribbon cassette 21A accommodating the ink ribbon 14A used for the cool peeling operation, the peeling lever 20 can be selectively operated to cause a swing motion only when the ribbon cassette 21A accommodating the ink ribbon 14A used for the cool peeling operation.

Figure 10:
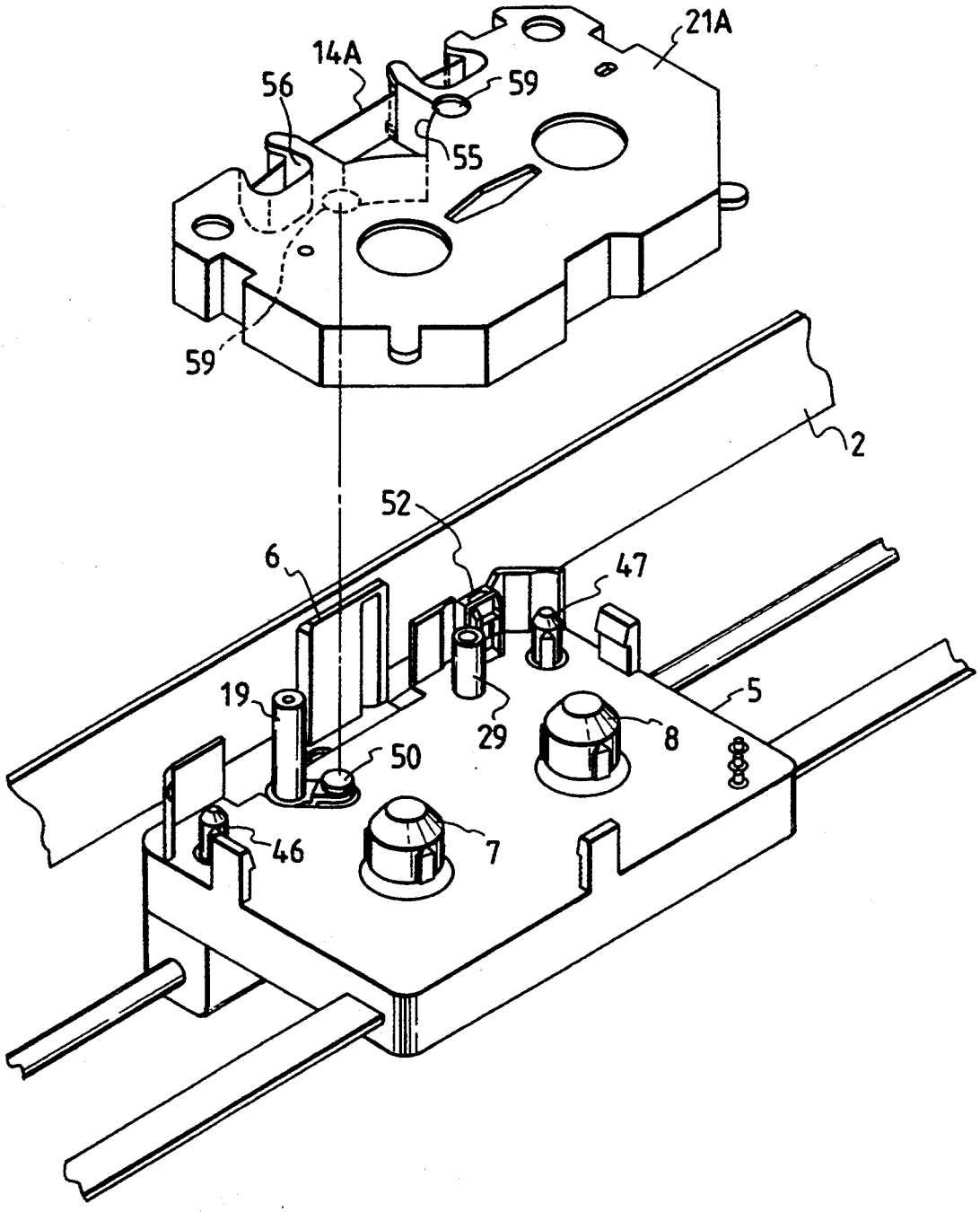
FIG. 10 is a perspective view showing a thermal transfer printer in accordance with a second embodiment of the present invention.
Figure 11:
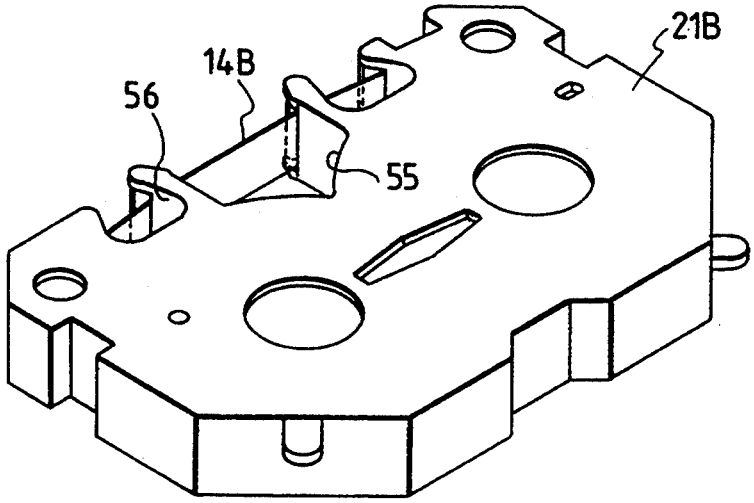
FIG. 11 is a perspective plane view showing a ribbon cassette used for the cool peeling operation of the thermal transfer printer in accordance with the second embodiment of the present invention.
Figure 12:
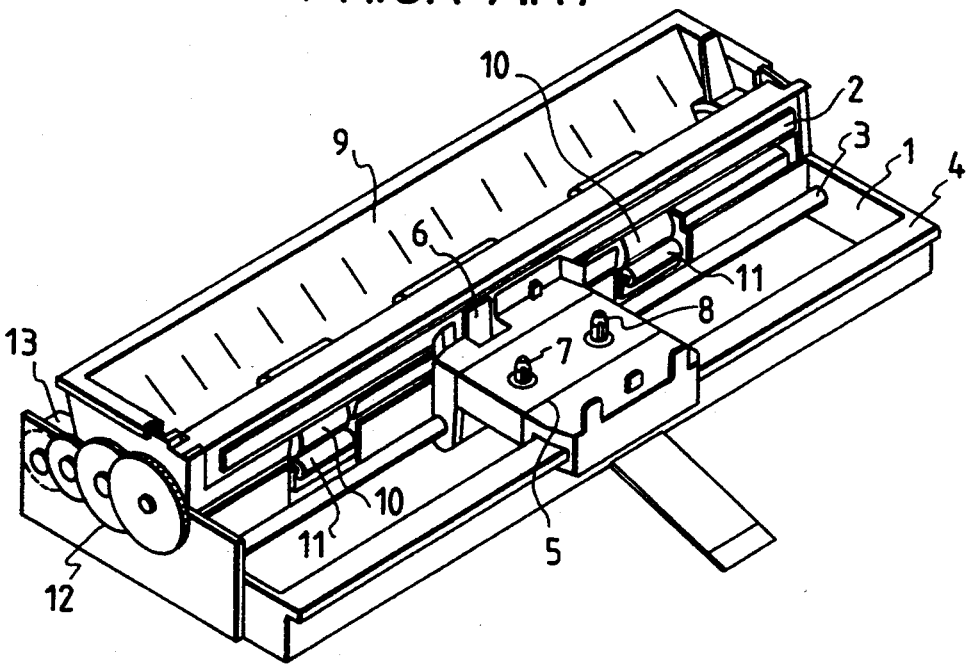
FIG. 12 PRIOR ART
FIG. 12 is a perspective view showing a conventional thermal transfer printer.
Figure 13A:
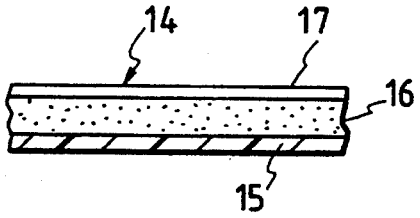
FIG. 13(A) PRIOR ART
FIGS. 13(A) and 13(B) are cross-sectional views showing conventional ink ribbons used for the hot peeling operation.
Figure 13B:
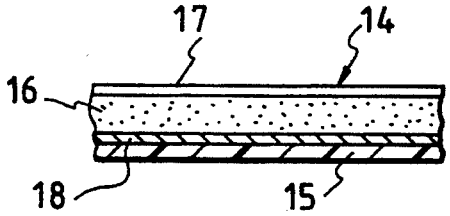
FIG. 13(B) PRIOR ART
Figure 13C:
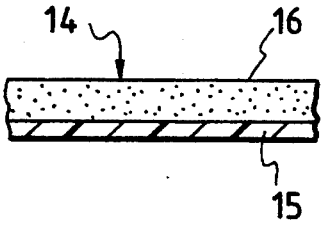
FIG. 13(C) PRIOR ART
FIG. 13(C) is a cross-sectional view showing another conventional ink ribbon used for the cool peeling operation; and, FIG. 14 a schematic view showing peeling roller configuration of the conventional thermal transfer printer.
Figure 14:
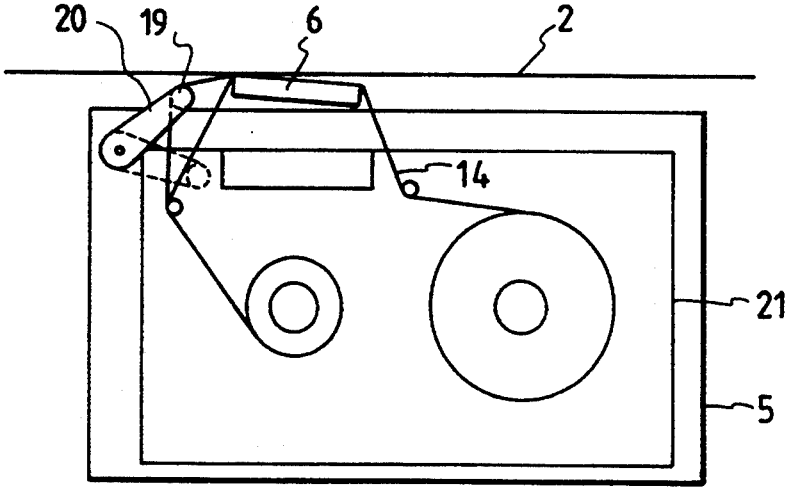
FIG. 14 PRIOR ART

FIGS. 10 and 11 show a thermal transfer printer in accordance with a second embodiment of the present invention. This thermal transfer printer in accordance with the second embodiment has the same configuration as that of the first embodiment except for the engaging pin 50 provided on the carriage 5 and the press board pressing the engaging pin 50 formed in the ribbon cassette 21.

In this second embodiment, the engaging pin 50 positions inwardly on the carriage 5 compared with the first embodiment. The ribbon cassette 21A accommodating the ink ribbon 14A used for the cool peeling operation forms a recessed portion 59 so as to confront with the engaging pin 50 on the carriage 5. Accordingly, the engaging pin 50 is not depressed when the ink ribbon cassette 21A is installed on the carriage 5. This recessed portion 59 can be formed as a through hole passing through the ribbon cassette 21A.

Furthermore, as shown in FIG. 11, the ribbon cassette 21B accommodating the ink ribbon 14B used for the hot peeling operation forms no recessed portion described above. The case of the ribbon cassette 21B serves as a press board. When the ribbon cassette is installed on the carriage 5, the engaging pin 50 is depressed by the case of the ribbon cassette 21B. Then, the lower end of the engaging pin 50 engages with the head lever 30 as shown in FIG. 7(*b*). When the head lever 30 is swung, the peeling lever 20 rotates through the engaging pin 50. The peeling roller 19 is pressed by the platen 2, and the peeling distance of the ink ribbon 14B is enlarged.

The present invention is, however, not limited to the previous embodiments and therefore can be modified in various ways.

As is explained in the foregoing description, in accordance with the thermal transfer printer of the present invention, the engaging member (i.e. engaging pin) of the peeling lever is pressed so that the engaging member engages with the head lever. The peeling lever is moved by rotating the head lever, so that the peeling member (i.e. peeling roller) can be brought into contact with or released from the platen. Thus, no additional driving device for driving the peeling lever is required. The control of the driving device becomes easy. Furthermore, an overall size of the apparatus can be reduced as the carriage needs not to provide a wide installation space. Moreover, the cost of parts reduces and the apparatus can be manufactured at low cost.

Still further, as the press portion (i.e. press board) pressing the engaging member is provided in accordance with the kind of the ink ribbon of the ribbon cassette, the peeling lever can be selectively operated to cause a swing motion in accordance with the kind of the ink ribbon of the ribbon cassette to be used.

As this invention may be embodied in several forms without departing from the spirit of essential characteristics thereof, the present embodiments are therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. A thermal transfer printer comprising:

a carriage provided such that the carriage reciprocates along a platen, the carriage having an upper surface;

a thermal head disposed on the carriage;

a ribbon cassette accommodating an ink ribbon therein and detachably installed on the upper surface of the carriage;

a head operating mechanism for supporting the thermal head on the carriage and for moving the thermal head into contact with and away from the platen;

a driving means for driving the head operating mechanism;

a peeling member mounted on the carriage and adjustable to contact with or be positioned away from the platen in order to change a distance between a printing portion by the thermal head and a peeling portion where the ink ribbon is peeled off after finishing a printing operation; and a peeling lever mounting the peeling member at a distal end thereof and including an engaging member which is pressed to engage with the head operating mechanism in accordance with a kind of the ribbon cassette.

2. A thermal transfer printer in accordance with claim 1, wherein said peeling member is a peeling roller.

3. A thermal transfer printer in accordance with claim 1, wherein said engaging member is an engaging pin.

4. A thermal transfer printer in accordance with claim 1, a ribbon cassette pressing said engaging member is a ribbon cassette accommodating an ink ribbon used for a cool peeling operation.

5. A ribbon cassette accommodating an ink ribbon therein, which is used in a thermal transfer printer comprising:

a carriage provided such that the carriage reciprocates along a platen, the carriage having an upper surface for detachably receiving the ribbon cassette;

a thermal head disposed on the carriage;

a head operating mechanism for supporting the thermal head on the carriage and for moving the thermal head into contact with and away from the platen;

a driving means for driving this head operating mechanism; and a peeling member mounted on the carriage and adjustable to contact with or be positioned away from the platen in response to movement of a peeling lever in order to change a distance between a printing portion by the thermal head and a peeling portion where the ink ribbon is peeled off after finishing a printing operation, said ribbon cassette comprising:

a cassette case including a press member for pressing an engaging member of the peeling lever provided on the carriage in a condition where said ribbon cassette is installed on said carriage such that the peeling member is in contact with the platen.

6. A ribbon cassette in accordance with claim 5, wherein said press member is a press board.

7. A ribbon cassette in accordance with claim 5, wherein said press member is said cassette case of the ribbon cassette.

8. A ribbon cassette accommodating an ink ribbon therein, which is used in a thermal transfer printer comprising:

a carriage provided such that the carriage reciprocates along a platen, the carriage having an upper surface for detachably receiving the ribbon cassette;

a thermal head disposed on the carriage;

a head operating mechanism for supporting the thermal head on the carriage and for moving the thermal head into contact with and away from the platen;

a driving means for driving this head operating mechanism; and a peeling member mounted on the carriage and adjustable to contact with or be positioned away from the platen in response to movement of a peeling lever in order to change a distance between a printing portion by the thermal head and a peeling portion where the ink ribbon is peeled off after finishing a printing operation, said ribbon cassette comprising:

a cassette case including a pin reception area for receiving an engaging member of the peeling lever provided on the carriage in a condition where said ribbon cassette is installed on said carriage such that the peeling member is positioned away from the platen.

9. A ribbon cassette in accordance with claim 8, wherein said pin reception area is a recessed portion.

10. A ribbon cassette in accordance with claim 8, wherein said pin reception area is a through hole.

11. A thermal transfer printer comprising:

a carriage provided such that the carriage reciprocates along a platen, the carriage having an upper surface;

a thermal head disposed on the carriage;

a ribbon cassette accommodating an ink ribbon therein and detachably installed on the upper surface of the carriage;

a head operating mechanism for supporting the thermal head on the carriage and for moving the thermal head into contact with and away from the platen;

a support shaft for rotatably mounting said head operating mechanism; and a head press lever swingably mounted on said support shaft to engage with said head operating mechanism for rotating said head operating mechanism by a driving mechanism;

said support shaft being formed to protrude upward from the upper surface of the carriage.

12. A ribbon cassette accommodating an ink ribbon therein, which is used in a thermal transfer printer comprising:

a carriage provided such that the carriage reciprocates along a platen, the carriage having an upper surface for detachably receiving the ribbon cassette;

a thermal head disposed on the carriage;

a head operating mechanism for supporting the thermal head on the carriage and for moving the thermal head into contact with and away from the platen;

a support shaft for rotatably mounting said head operating mechanism; and a head press lever swingably mounted on said support shaft to engage with said head operating mechanism for rotating said head operating mechanism by a driving mechanism;

said ribbon cassette comprising a cassette case including a cutout portion into which said support shaft is inserted.

13. A ribbon cassette in accordance with claim 12, wherein said cutout portion is formed symmetrically at right and left portions of the ribbon cassette, so that the ribbon cassette can be reversely used.

* * * * *